US010401114B2

(12) United States Patent
Floyd

(10) Patent No.: US 10,401,114 B2
(45) Date of Patent: Sep. 3, 2019

(54) FIREARM REAR STABILIZING CRUTCH AND SYSTEM

(71) Applicant: Floyd Products LLC, Key Largo, FL (US)

(72) Inventor: John Franklin Floyd, Key Largo, FL (US)

(73) Assignee: Floyd Products LLC, Key Largo, FL (US)

( * ) Notice: Subject to any disclaimer, the term of this patent is extended or adjusted under 35 U.S.C. 154(b) by 0 days.

(21) Appl. No.: 15/785,823

(22) Filed: Oct. 17, 2017

(65) Prior Publication Data

US 2018/0120046 A1 May 3, 2018

Related U.S. Application Data

(60) Provisional application No. 62/416,203, filed on Nov. 2, 2016.

(51) Int. Cl.
*F41C 27/00* (2006.01)
*F41A 23/06* (2006.01)
*F41C 27/22* (2006.01)

(52) U.S. Cl.
CPC ..... *F41A 23/06* (2013.01); *F41C 27/22* (2013.01)

(58) Field of Classification Search
CPC ..... F41A 23/16; F41A 23/04; F41A 23/12; F41A 23/14; F41C 27/22
USPC ..... 42/94; 73/167; 89/40.06, 37.04, 37.03; 248/688, 689, 121, 125.1
See application file for complete search history.

(56) References Cited

U.S. PATENT DOCUMENTS 4,196,742 A * 4/1980 Owen, Jr. ..... A61H 3/0288 135/66
5,819,461 A 10/1998 Killian
5,930,933 A * 8/1999 Schleicher ..... F41A 23/16 42/94
6,085,766 A 7/2000 Geary
6,920,713 B1 7/2005 Love
7,356,960 B1 * 4/2008 Knitt ..... F41A 23/16 42/94
7,406,794 B1 * 8/2008 Pope, Jr. ..... F41A 23/16 42/94
7,584,568 B1 * 9/2009 Brownlee ..... F41A 23/12 42/94
8,522,470 B2 9/2013 Mangum
8,549,786 B1 * 10/2013 Griffith ..... F41A 23/16 42/94

(Continued)

*Primary Examiner* — Michael D David
(74) *Attorney, Agent, or Firm* — Dority & Manning, P.A.

(57) ABSTRACT

A firearm rear stabilizing crutch is disclosed having a shaft with a proximal end and a distal end, and an underarm firearm support on the proximal end of the shaft. The underarm firearm support has a support base with front and rear ends and a top element extending therebetween, with the top element defining a generally curved profile extending from proximate the front end to proximate the rear end. A support nose extends from the front end of the support base, with the support nose defining a recess therein for accommodating a firearm buttstock. The distal end of the shaft is configured to be engaged with the ground when the crutch is being used to support a firearm in a shooting position. Some embodiments of the crutch include integrated storage for the shaft and spikes.

19 Claims, 7 Drawing Sheets

(56) References Cited

U.S. PATENT DOCUMENTS

| | | | | |
|---|---|---|---|---|
| 8,869,444 | B2 * | 10/2014 | Bosco | F41C 33/001 42/71.01 |
| 2007/0169391 | A1 * | 7/2007 | Carpenter | F41A 23/14 42/94 |
| 2009/0126250 | A1 * | 5/2009 | Keng | F41A 23/10 42/94 |
| 2010/0218411 | A1 * | 9/2010 | Keng | F41A 23/10 42/94 |
| 2010/0218670 | A1 * | 9/2010 | Keng | F41A 23/14 89/37.04 |
| 2011/0308131 | A1 * | 12/2011 | McLinda | A01K 97/10 42/94 |
| 2013/0174463 | A1 * | 7/2013 | Hinds | F41A 23/04 42/94 |
| 2013/0232844 | A1 * | 9/2013 | Gallo | A45B 3/00 42/94 |

* cited by examiner

FIREARM REAR STABILIZING CRUTCH AND SYSTEM

CROSS-REFERENCE TO RELATED APPLICATIONS

This application claims the benefit of U.S. Provisional Application No. 62/416,203, filed Nov. 2, 2016, the disclosure of which is hereby incorporated by reference herein in its entirety for all purposes.

FIELD OF THE DISCLOSURE

The disclosure relates generally to the field of stabilizing systems. More particularly, the present subject matter relates to a device and system having ground-supported gun rests, or crutches to provide increased stability when firing a firearm.

BACKGROUND OF THE DISCLOSURE

Hunters and target shooters often have difficulty keeping their firearm steady during aiming and shooting. Various factors contribute to that difficulty including weather, physical infirmities, awkward shooting locations, and bodily movements or vibrations caused by breathing, heartbeat, nervous 'jitters' and other physiological processes.

Most field firearm stabilizing assistance has been provided near the front or barrel of a firearm using bipods or tripods that support the gun weight and minimize the front motion of the firearm. However, to date, the industry has neglected providing adequate stabilization or isolation using rear-only or buttstock-only firearm support, where movements from the shoulder, arm and hands can be transmitted into the buttstock of the firearm and impair siting for accurate fire.

BRIEF DESCRIPTION OF THE DISCLOSURE

Aspects and advantages of the disclosure will be set forth in part in the following description, or may be obvious from the description, or may be learned through practice of the disclosure.

In one embodiment, a firearm rear stabilizing crutch is disclosed having a shaft with a proximal end and a distal end, and an underarm firearm support supported on the proximal end of the shaft. The underarm firearm support has a support base with front and rear ends and a top element extending therebetween, with the top element defining a generally curved profile extending from proximate the front end to proximate the rear end. Additionally, a support nose extends from the front end of the support base, with the support nose defining a recess therein for accommodating a firearm buttstock. The distal end of the shaft is configured to be engaged with the ground when the crutch is being used to support a firearm in a shooting position.

In another embodiment, a firearm stabilizing dual support system is disclosed having a front stabilizing support in direct contact between a front portion of a firearm and the ground, and a rear stabilizing crutch, as described above, in direct contact between a buttstock of the firearm and the ground.

These and other features, aspects and advantages of the present disclosure will become better understood with reference to the following description and appended claims. The accompanying drawings, which are incorporated in and constitute a part of this specification, illustrate embodiments of the disclosure and, together with the description, serve to explain the principles of the disclosure.

BRIEF DESCRIPTION OF THE DRAWINGS

A full and enabling disclosure, including the best mode thereof, directed to one of ordinary skill in the art, is set forth in the specification, which makes reference to the appended figures, in which.

Figure 1:
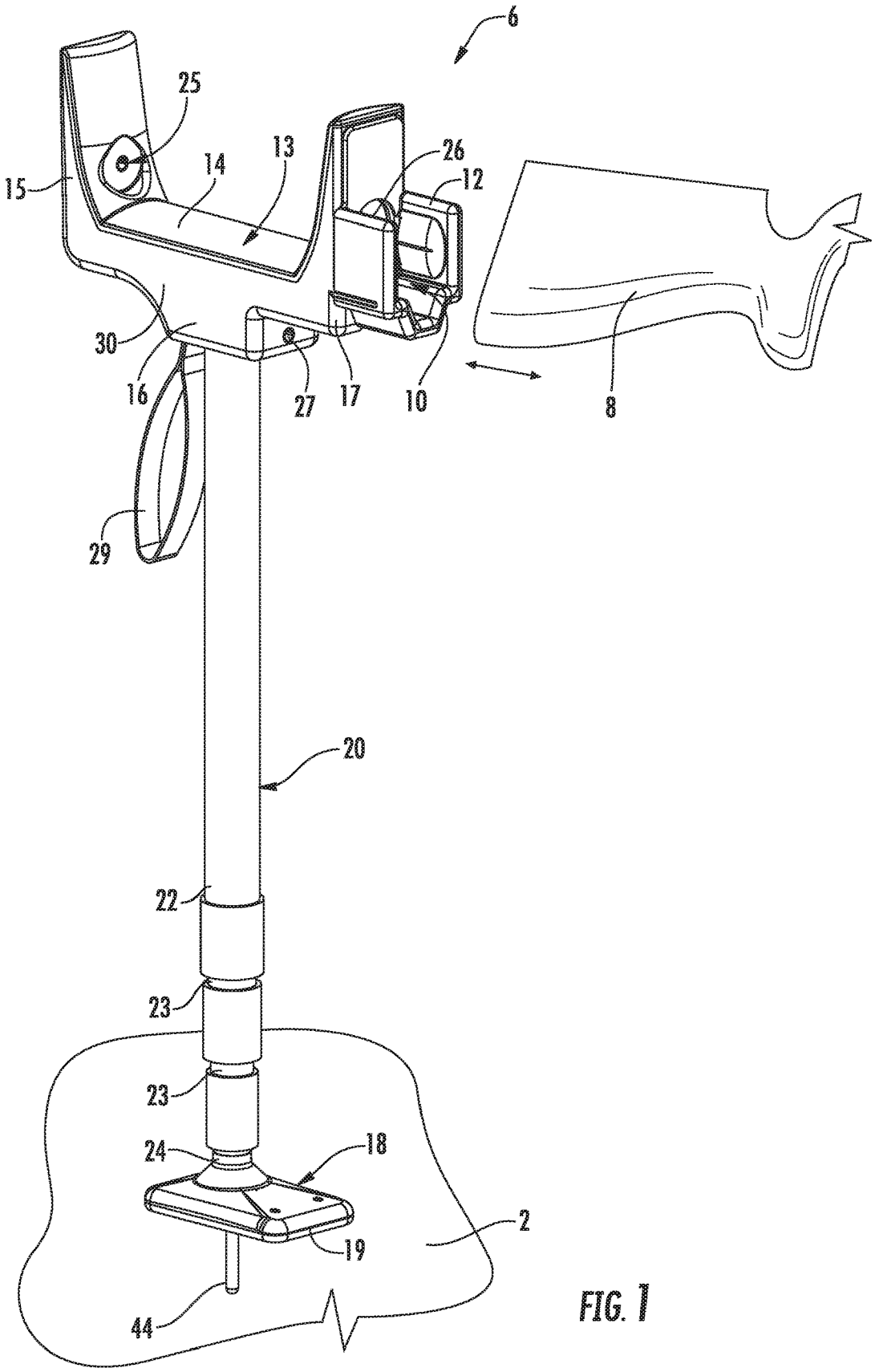
FIG. 1 illustrates a perspective view of an embodiment of a rear stabilizing crutch supporting a firearm in accordance with aspects of the present subject matter.

Repeat use of reference characters in the present specification and drawings is intended to represent the same or analogous features or elements of the present disclosure.

DETAILED DESCRIPTION OF THE DISCLOSURE

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

The term "firearm" is defined herein as any weapon including but not limited to rifles, shotguns, pistols, handguns, crossbows, revolvers or any shoulder fired weapon. The term "ground" is defined herein as any surface adjacent the shooter that provides stable support for a device being used by the shooter, for example, the "ground" can be soil of the earth, a deer stand floor, a vehicle floor, a weighted vessel, or any continuance of ground support.

Figure 2:
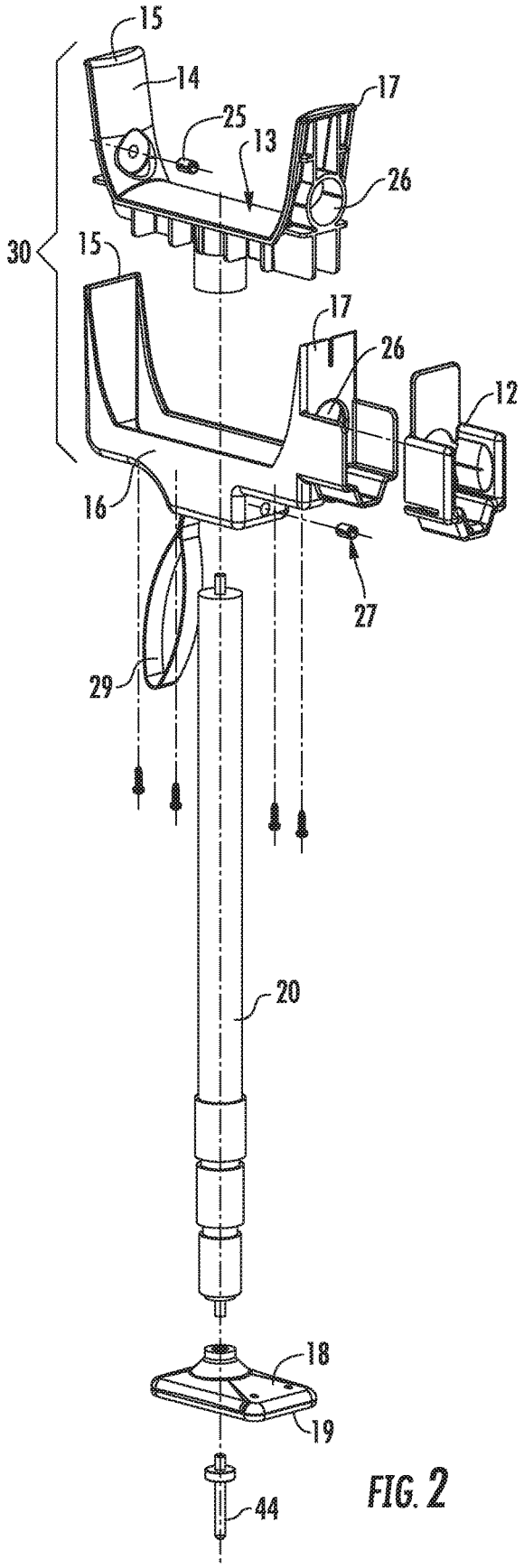
FIG. 2 illustrates an exploded perspective view of an embodiment of a rear stabilizing crutch in accordance with aspects of the present subject matter.
Figure 3:
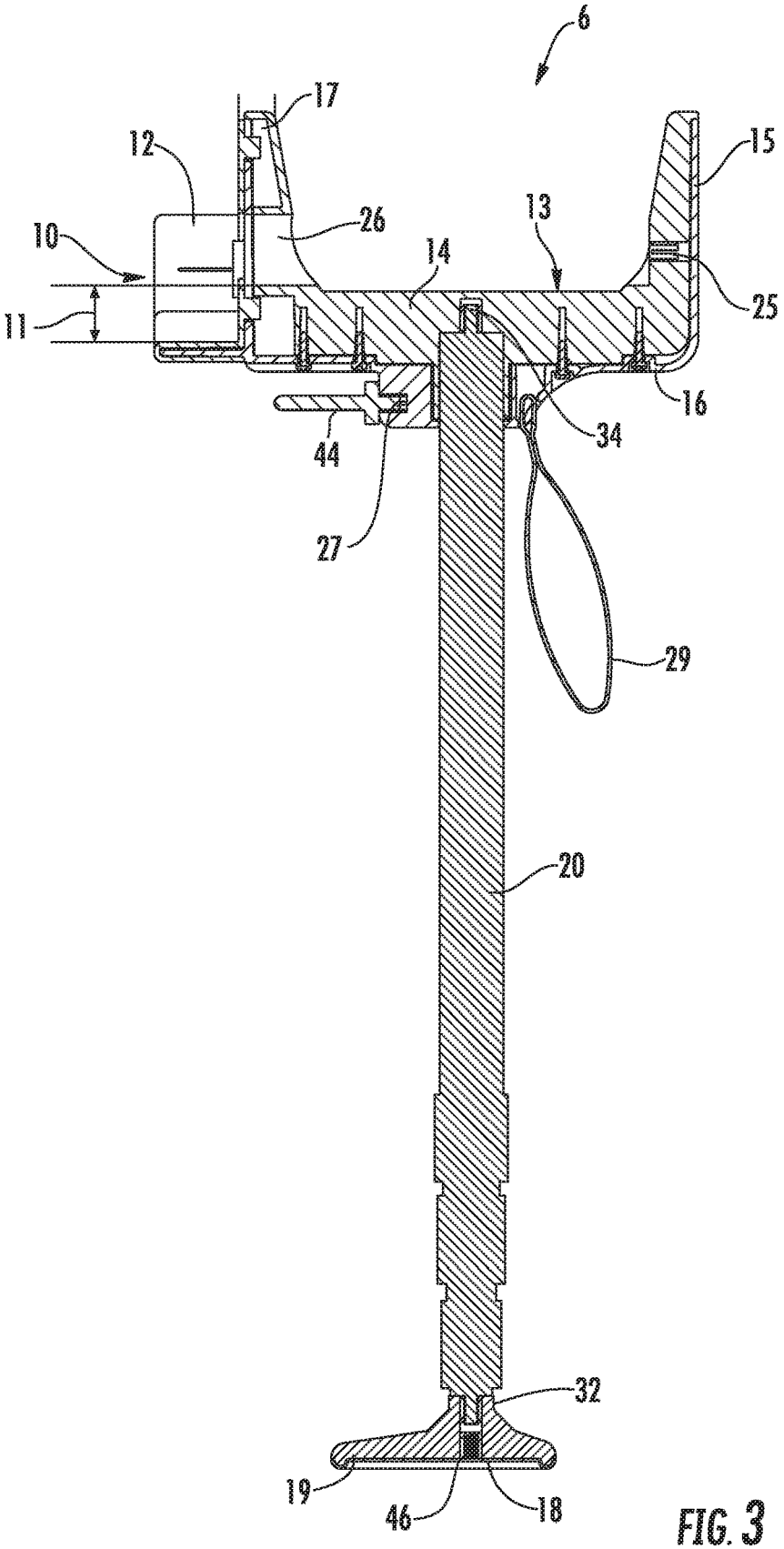
FIG. 3 illustrates a side view of an embodiment of a rear stabilizing crutch with structural features in accordance with aspects of the present subject matter.

Referring now to the drawings, wherein like numerals refer to like components, FIGS. 1-3 illustrate an embodiment of a rear stabilizing crutch 6 configured to support the rear end or buttstock of a firearm 8 in accordance with aspects of the present subject matter. The rear stabilizing crutch 6 provides repeatable simulation of precise unsupported firing while the crutch 6 is actually being stabilized and supported by the ground 2. As shown, the rear stabilizing crutch 6 may generally include a shaft 20 and an underarm firearm support 30 positioned atop the shaft 20. In general, the shaft 20 may be configured to extend between the underarm firearm support 30 and a shaft base 18 configured to be in contact with the ground 2. In one embodiment, the shaft 20 may be in fixed in length. In such an embodiment, the shaft 20 may be interchangeable with other shafts having differing lengths to accommodate differing shooting position. Alternatively, as will be described below, the shaft 20 may be adjustable in length, such as by being telescoping.

As shown in FIGS. 1-3, the underarm firearm support 30 may include a support base 16 having a front end 17, a rear end 15 and a top element 14 mounted atop the support base 16. The top element 14 can define a u-shaped gradient or curved profile 13 extending from proximate the front end 17 to proximate the rear end 15 to accommodate the underarm of the shooter. In addition, the underarm firearm support 30 may include a support nose 12 extending from the front end 17 of the support base 16. In one embodiment, the support nose 12 may be formed integrally with the support base 16. Alternatively, the support nose 12 may be separately coupled to the support base 16. The support nose 12 can provide an interlock with a shaft storage port 26 extending from the top element 14 such that the support nose 12 snap-connects to the shaft storage port 26 to enable snug assembly of the underarm firearm support 30. The support nose 12 can include an adjustable offset angle for laterally and vertically adjusting the centerline direction of the support nose 12 mounted to the underarm firearm support 30, thereby allowing custom fitting for both shooter and firearm 8. The offset angle can be set by a removable oblique insert, positioned between the support base 16 and the support nose 12, that slants at the desired angle in the desired vertical or horizontal direction.

The support nose 12 may, in several embodiments, define a recess 10 therein for accommodating the rear end of a firearm 8 buttstock. It should be appreciated that the support nose 12 and associated recess 10 may generally be configured to have any suitable shape that allows the rear end of buttstock of the firearm 8 to remain supported within the nose recess 10 during aiming and firing. In addition, the support nose 12 may, in one embodiment, be removably coupled to the support base 16. In such an embodiment, the support nose 12 may, for example, be interchangeable with other noses 12 having recesses 10 configured to be used with a given firearm 8 having a specific rear end or buttstock configuration.

As shown in FIG. 3, an adjustable recess height 11 may be defined between the bottom of the support nose recess 10 and the bottom end or lowermost portion of the curved profile 13 defined by the top element 14. The adjustable recess height 11 maintains the same natural position of an unsupported firearm 8 in contact with the shoulder of the shooter while also allowing for natural head tilt, cheek rest and proper eye alignment during target siting. The adjustable recess height 11 allows the shooter to maintain precise parallax adjustments in high-power scopes for repeatable firing while the firearm 8 is being supported by the rear stabilizing crutch 6. Once a specific firearm 8 is calibrated, or "zeroed", for desired shooting distances, the firearm 8 is then considered indexed to the rear stabilizing crutch 6, instead of being indexed to the shooter, thereby removing the shooter's misalignment variables and providing more accurate firing. In one embodiment, the recess height 11 may be equal to about 0.75 inches. However, in other embodiments, the recess height 11 may generally range from about 0.5 inch to about 2 inches, depending on the configuration of the firearm 8 being supported and the preference of the shooter. The recess height 11 can be adjusted by adding or removing padding to the top element 14 and/or the support nose 12.

It should be appreciated that additional features, such as adjustable nose side panels, padding, straps and/or the like for firearm retention, and customized recess shapes may also be used in accordance with aspects of the present subject matter. Two or more side panels can be disposed on the sides of the recess 10 in the support nose 12 to provide snug side support and maintain the buttstock in a vertical position. The support nose 12 and side panels can be constructed from a flexible material, such as a urethane rubber, that provides both grip and flexibility in the support nose 12 to fit a plurality of firearm 8 buttstock sizes and configurations.

During use of the disclosed rear stabilizing crutch 6 (e.g., when a shooter is leaning on the rear stabilizing crutch 6 while in a shooting position with his/her underarm resting on the top element 14 of the underarm firearm support 30), the rear stabilizing crutch 6 transfers the underarm weight of the shooter and the buttstock weight of the firearm 8 to the ground 2 via the connection of the shaft 20 with the ground 2. Thus, when the shooter is leaning on the rear stabilizing crutch 6, both the shooter's upper body torso and the firearm 8 are stabilized. This allows the shooter's body and physiological responses, such as respiratory motions, to be isolated from the firearm 8, thereby preventing transmission of unintended motion from the shooter's arms and torso to the firearm 8, thus, enabling more accurate aim and fire.

It should be appreciated that, in addition to vertical support, the rear stabilizing crutch 6 may also be configured to provide horizontal or angled support, thereby preventing unintended horizontal movement. For example, the rear stabilizing crutch 6 can also be used in a non-vertical position, such as angled backward, so that the support base 16 is positioned behind the shooter, thereby allowing for both vertical and horizontal support of the firearm 8. This embodiment can provide an angled attachment of both the underarm firearm support 30 and the support base 16 to the shaft 20 to accommodate the shaft 20 angle and provide proper comfort and support.

Additionally, as indicted above, the shaft 20 of the rear stabilizing crutch 6 may, in several embodiments, be adjustable in length, thereby allowing the rear stabilizing crutch 6 to accommodate a plurality of shooting positions, such as standing, seated, kneeling, and prone shooting positions. The adjustable shaft 20 can also be used to adjust for variable shooter torso sizes and body types. The shaft 20 can include any number of adjustable sections to accommodate multiple shooting styles such as youth, ladies, men, and handicapped. For example, seated or prone shooting may require only two shaft 20 sections, whereas standing, angled, or un-level ground may require five shaft 20 sections. Shaft 20 sections can be added or removed as-needed by relocating the support base coupling 32 and support base 16 to the selected lower shaft tube 24. In addition, a shaft extension of desired length can be added to the upper shaft tube 22 to raise the underarm firearm support 30 to a desired height above the length of the upper shaft tube 22.

Figure 4:
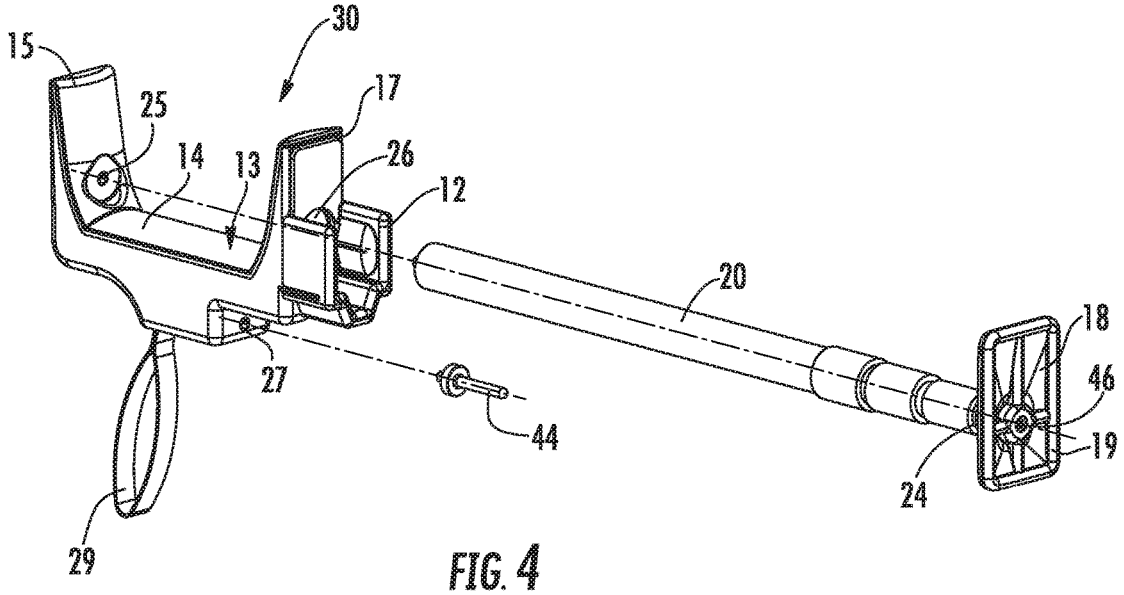
FIG. 4 illustrates a disassembled view of a rear stabilizing crutch positioned for completion of integrated storage in accordance with aspects of the present subject matter.

Referring to FIG. 3, structural features of an embodiment of an underarm firearm support 30 suitable for use with the disclosed rear stabilizing crutch 6 are illustrated in accordance with aspects of the present subject matter. As indicated above, the underarm firearm support 30 may include a support base 16 having a support nose 12 extending therefrom, with the support nose 12 defining a recess 10 for supporting the buttstock of a firearm 8. As shown in the illustrated embodiment, the support base 16 and support nose are formed integrally with one another such that the underarm firearm support 30 corresponds to a single integrated component. Additionally, as shown in FIGS. 3 and 4, the support base 16 may include a front end 17, a rear end 15, and a top element 14 extending therebetween, with the top element 14 defining a u-shaped gradient or curved profile 13 extending from proximate the front end 17 to proximate the rear end 15 so as to accommodate the underarm of the shooter. As indicated above, the underarm firearm support 30 may also define a recess height 11 between the bottom of the recess 10 and the bottom end or lowermost portion of the curved profile 13 defined by the top element 14 of the support base 16. In one embodiment, the recess height 11 may be equal to about 0.75 inches. However, in other embodiments, the recess height 11 may generally range from about 0.5 inch to about 2 inches, depending on the configuration of the firearm 8 being supported by the disclosed rear stabilizing crutch 6.

FIG. 4 shows a disassembled embodiment of the rear stabilizing crutch 6 positioned for completion of integrated storage in accordance with aspects of the present subject matter. The lower shaft tube 24 can removably engage with the shaft base 18 to further stabilize the rear stabilizing crutch 6 while in contact with the ground 2. The shaft base 18 can be any suitable size and large enough, for example about 4 inches by 2.5 inches, to effectively support the rear stabilizing crutch 6 in a free-standing position. The shaft base 18 can also be mounted to the shaft 20 using a swivel connection to allow adjustment of the angle between the shaft base 18 and the shaft 20. The shaft base 18 can have a shoe portion 19 positioned between the shaft base 18 and the ground 2 to provide a friction surface and prevent slippage. The shoe portion 19 can be constructed from a urethane rubber and snap onto the shaft base 18 for removable and replaceable service. Ribs can be used in constructing the shaft base 18 to strengthen the shaft base 18 structure and provide additional mounting surfaces for the shoe portion 19.

The shaft base 18 can also couple with at least one spike 44 removably coupled to the base 18 to provide positive engagement with the ground 2. In FIG. 4, the spike 44 is shown removed from the spike coupling 46 and positioned for storage insertion into the spike storage retainer 27. The at least one spike 44 can have different lengths for providing ground 2 penetration depth sufficient for stabilizing the rear stabilizing crutch 6. The spike 44 length can vary depending on the porosity and density of the ground 2. The at least one spike 44 can also be angled for providing downward and horizontal force vectors. Multiple spikes 44 can also be removably coupled at various locations on the shaft base 18.

Figure 5:
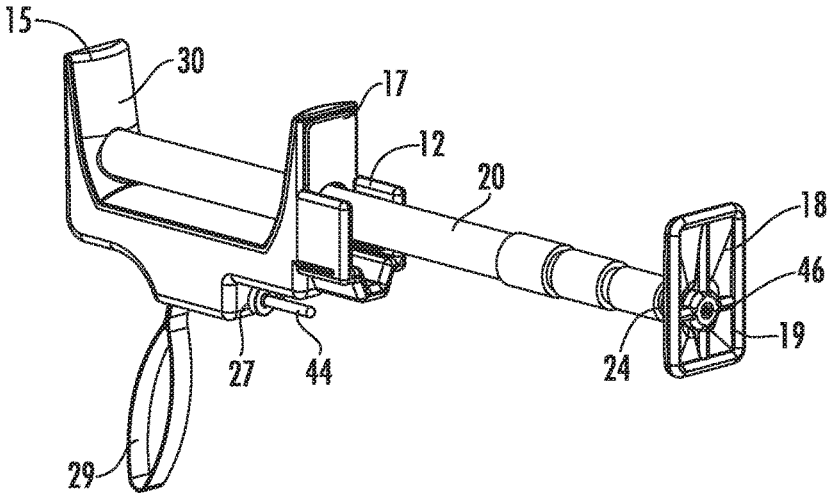
FIG. 5 illustrates an integrated storage position view of a rear stabilizing crutch in accordance with aspects of the present subject matter.

FIG. 5 shows a rear stabilizing crutch 6 embodiment with shaft 20 and spike 44 in the integrated storage position for transport. The shaft base 18 can also be stored while engaged with the lower shaft tube 24. The front end 17 of the underarm firearm support 30 comprising both the support base 16 and the top element 14 can be bored with a shaft storage port 26 to provide integrated storage of the shaft 20. At least one spike 44 can be threadably engaged with the spike storage retainer 27 for storage during transport.

Figure 6:
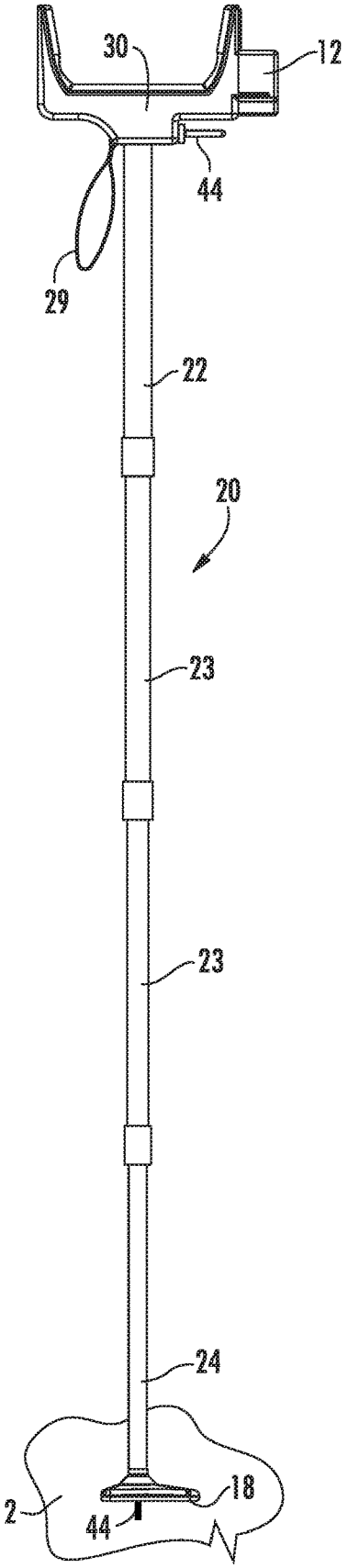
FIG. 6 illustrates an extended shaft view of a rear stabilizing crutch in accordance with aspects of the present subject matter.

FIG. 6 illustrates an extended shaft 20 side view of a rear stabilizing crutch 6 in accordance with aspects of the present subject matter. This embodiment can be used in a standing position for providing direct contact with the ground 2 for both the firearm 8 and the shooter. As described above, multiple upper shaft tubes 22, middle shaft tubes 23, and lower shaft tubes 24 can be used to extend the length of the shaft 20 for stabilizing the shooter and the firearm 8. The length of each shaft tube 22, 23, 24 can be adjusted by telescoping the shaft tube in or out of the adjacent shaft tube and securing the selected position with, for example, twist-lock mechanisms or cam lock mechanisms at the interface of each shaft tube 22, 23, 24.

The shaft 20 length may be adjusted to accommodate different shooting positions and/or transporting positions for the rear stabilizing crutch 6. The shaft 20 may correspond to a telescoping shaft having, for example, three telescoping members (e.g., an upper shaft tube 22, a middle shaft tube 23, and a lower 24 shaft tube). However, in other embodiments, the shaft may include any other suitable number of telescoping members, such as two telescoping members or five or more telescoping members. In several embodiments, the various shaft tubes 22, 23, 24 may be made of a high-strength, lightweight material, such as aluminum or other suitable materials. Additionally, in the illustrated embodiment, the upper shaft tube 22 may be configured to receive the middle shaft tube 23 while the middle shaft tube 23 may be configured to receive the lower shaft tube 24 to provide the desired telescoping functionality. Moreover, in one embodiment, the shaft tubes 22, 23, 24 may be configured to be interlocked or connected to one another by twist-lock mechanisms or cam lock mechanisms. Alternatively, the telescoping shaft tubes 22, 23, 24 may be interconnected using any other suitable means, such as by using collar couplings (e.g., shaft collars or clamp collars) that can screw-tighten for compression retention or by using clamps or set screws to securely hold the desired shaft tube position.

The upper shaft tube 22 or the lower shaft tube 24 can removably couple with the underarm firearm support 30 and the shaft base 18, respectively, depending on the position of the shooter. Using a single shaft tube as the shaft 20, the rear stabilizing crutch 6 assembly can stabilize the firearm for a prone shooter at any height required for comfort of the shooter (see FIG. 7). Using both the upper shaft tube 22 and the lower shaft tube 24 as the shaft 20 in the rear stabilizing crutch 6 assembly can stabilize the firearm for a sitting shooter at any height required for comfort of the shooter (see FIG. 8). The firearm 8 position, as determined by the underarm firearm support 30 position, can be adjusted to any desired height above the ground by adjusting the shaft 20 to any desired length, for example from about 8 inches to about 60 inches above the ground.

Figure 7:
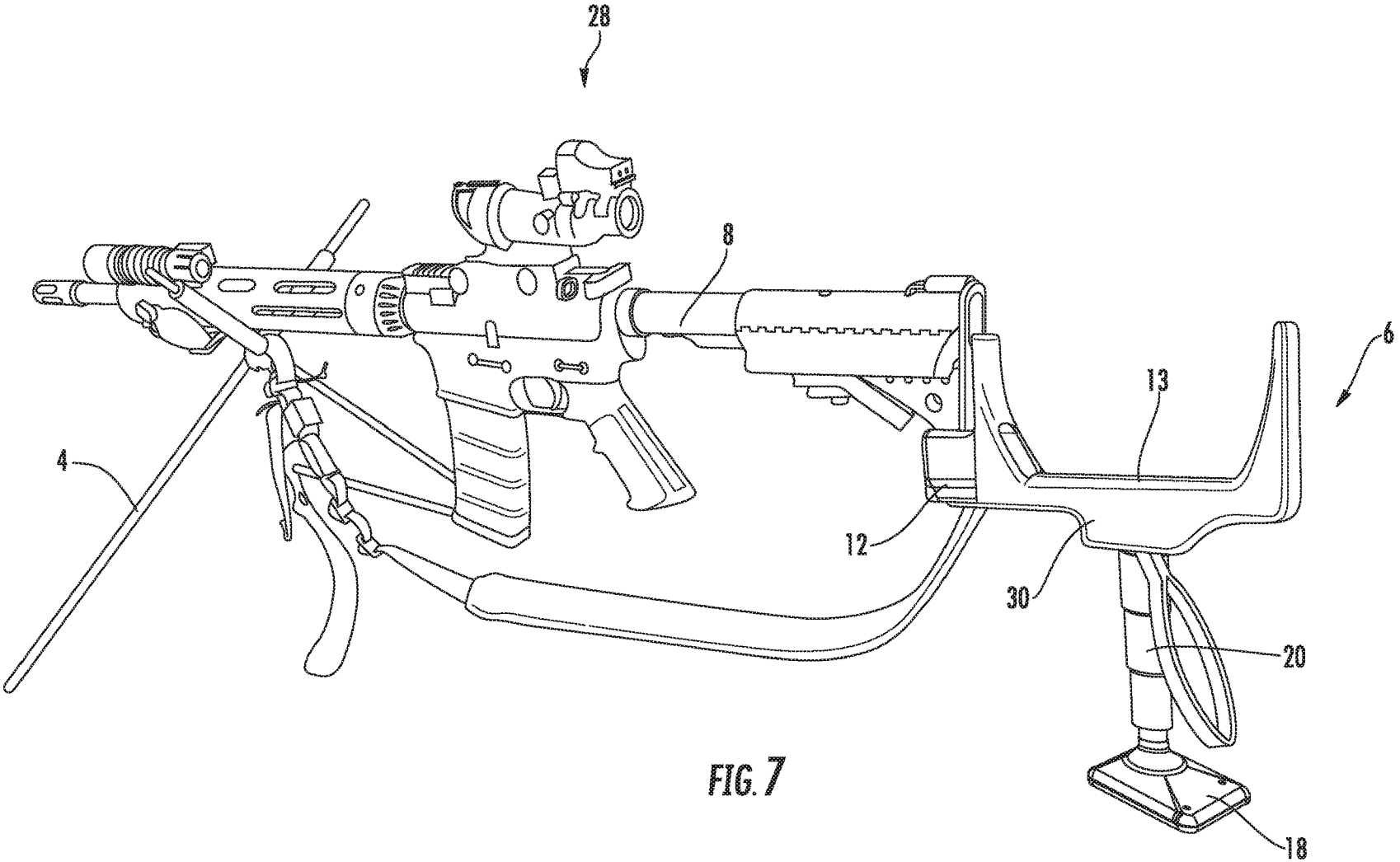
FIG. 7 illustrates an embodiment of the crutch in a firearm stabilizing dual support system with a front stabilizing support, for use in a prone position.

Referring now to FIG. 7, one embodiment of a free-standing, firearm stabilizing dual support system 28 is illustrated in accordance with aspects of the present subject matter, particularly illustrating both an embodiment of the disclosed rear stabilizing crutch 6 supporting the buttstock of a firearm 8 and a portion of a front stabilizing support 4 supporting a front portion of the firearm 8. As shown, the front stabilizing support 4 may be used in combination with the rear stabilizing crutch 6 to create a firearm stabilizing dual support system 28 for even more accurate aim and fire. It should be appreciated that the front stabilizing support 4 may correspond to any suitable support device that supports a front portion of the firearm 9, such as a tripod, a bipod, a tree, or any stable field equipment in firm contact with the ground 2.

Figure 8:
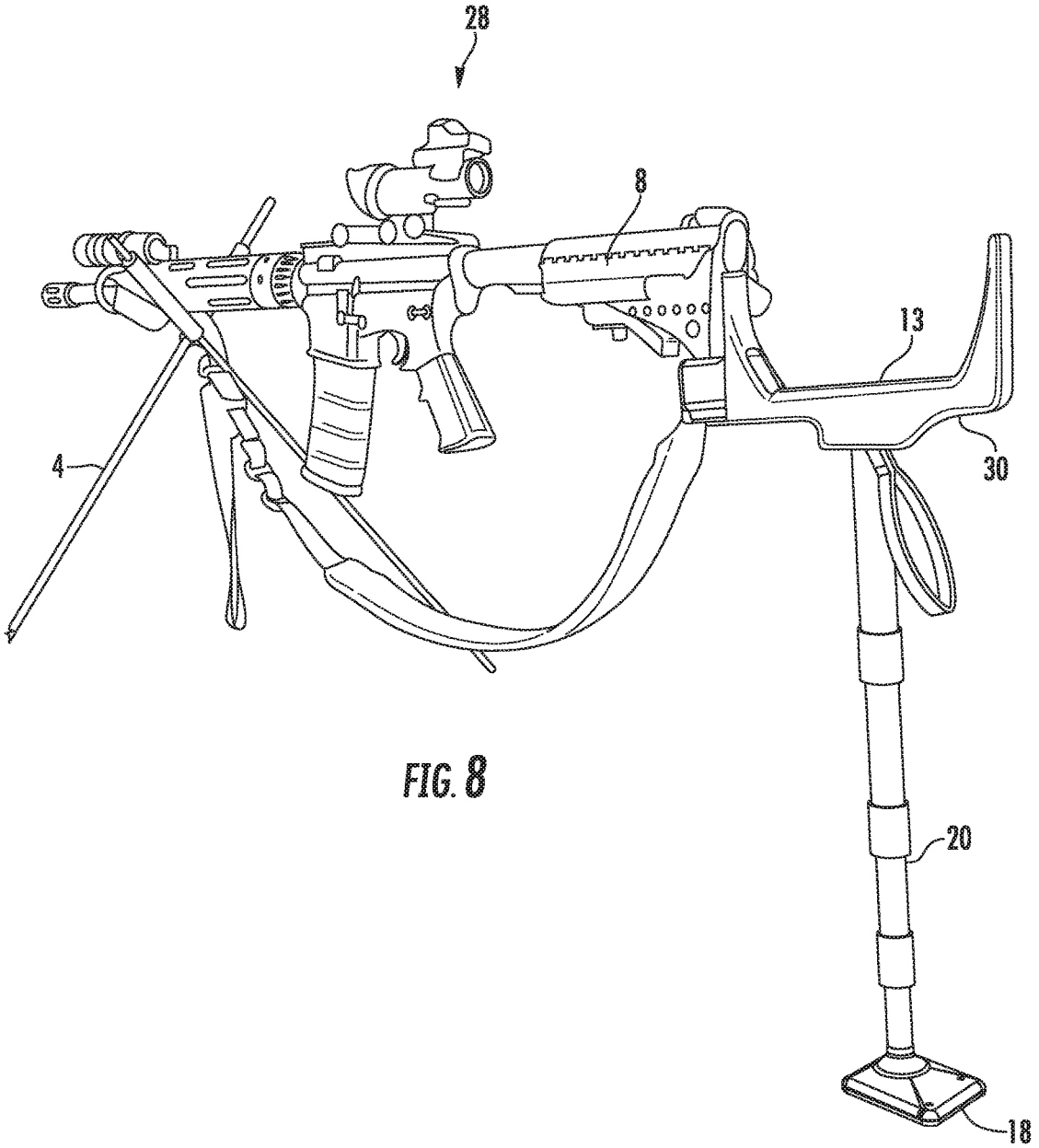
FIG. 8 illustrates an embodiment of the crutch in a firearm stabilizing dual support system with a front stabilizing support, for use in a seated position.

The dual support system 28 as configured in FIGS. 7 and 8 also allows the firearm 8 to stay in the proper shooting position while reloading the firearm with the free hand. After reloading, the firearm 8 is quickly positioned back on target, saving about 8 seconds of shooting time.

It should be appreciated that the disclosed rear stabilizing crutch 6 may be manufactured using any suitable method, such as injection molding, casting, 3D printing and/or combinations thereof. Additionally, the rear stabilizing crutch 6 may be manufactured as a single integrated piece or multiple pieces requiring assembly by the user. Moreover, the rear stabilizing crutch 6 may be formed from any suitable material, such as plastics, woods, metals, alloys, and mixtures thereof.

It should also be appreciated that the rear stabilizing crutch 6 may be adapted for purposes other than sport firearm shooting, for example, crossbow hunting, turkey hunting, big game hunting, military weaponry, and any other weapon that will benefit from buttstock ground-based support. Further, the rear stabilizing crutch 6 can be used as a training tool to teach beginners, as well as seasoned shooters, proper or improved firearm shooting position for accurate firing. Shooters can practice firing using the rear stabilizing crutch 6 to learn the 'feel' of proper siting and face-cheek rest positions on the firearm 8 which can be easily repeated in the field without using the crutch 6 and accomplish accurate firing. Additionally, the rear stabilizing crutch 6 may be adapted for photography equipment such as cameras as well as other equipment requiring stabilized support during operation.

This written description uses examples to disclose the invention, including the best mode, and also to enable any person skilled in the art to practice the invention, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A firearm rear stabilizing crutch, comprising;

a shaft having a proximal end and a distal end;

an underarm firearm support removably coupled to the proximal end of the shaft, the underarm firearm support comprising, a support base defining a front end and a rear end, the support base including a front wall positioned adjacent the front end, a rear wall positioned adjacent the rear end, and a base wall extending between the front and rear walls, the front wall, rear wall, and the base wall defining a U-shaped profile extending between the front and rear ends of the support base, a top surface of the base wall defining a bottom end of the U-shaped profile when the underarm firearm support is in a vertically upright position;

a support nose extending from said front end of said support base, said support nose defining a recess therein for accommodating a firearm buttstock, the recess extending vertically between a top end and a bottom end, and, wherein the bottom end of the recess is located vertically below the bottom end of the U-shaped profile by a recess height when the underarm firearm support is in the vertically upright position.

2. The crutch of claim 1, wherein said support nose is formed integrally with said support base or is configured to be removably coupled to said front end of said support base.

3. The crutch of claim 1, wherein said shaft includes two or more telescoping sections configured to allow a length of the shaft to be adjusted.

4. The crutch of claim 1, wherein said underarm firearm support further comprises a padded covering.

5. The crutch of claim 1, wherein said support nose is adjustable or flexible for fitting multiple firearm buttstock configurations.

6. The crutch of claim 1, further comprising a shaft base removably coupled to the distal end of the shaft, said shaft base comprising at least one spike.

7. The crutch of claim 6, wherein said support base incorporates integrated storage for said shaft and said at least one spike.

8. The crutch of claim 7, wherein the integrated storage comprises a shaft storage port, a shaft storage retainer, and a spike storage retainer.

9. The crutch of claim 1, wherein the recess height ranges from about 0.5 inch to about 2.0 inches.

10. The crutch of claim 9, wherein said recess height is about 0.75 inches.

11. The crutch of claim 1, wherein:

the base wall extends between the front and rear walls in a front-to-rear direction of the support base; and the proximal end of the shaft is removably coupled to the support base at a location between the front and rear walls of the support base in the front-to-rear direction of the support base.

12. The crutch of claim 11, wherein the proximal end of the shaft is centrally located between the front and rear walls of the support base in the front-to-rear direction of the support base when the proximal end is coupled to the support base.

13. The crutch of claim 11, wherein:

the top end of the recess defined by the support nose comprises an open top end of the recess and the bottom end of the recess defined by the support nose comprises a closed bottom end of the recess; and the support nose further comprises side panels extending between the open top end and the closed bottom end of the recess that define opposed lateral sides of the recess.

14. The crutch of claim 13, wherein the side panels are configured to flex to accommodate a firearm buttstock within the recess.

15. The crutch of claim 13, wherein the open top end of the recess is located vertically above the bottom end of the U-shaped profile when the underarm firearm support is in the vertically upright position.

16. The crutch of claim 1, wherein:

the support nose comprises a separate component configured to be separately coupled to the front end of the support base; and the support nose and the front wall of the support base defining aligned storage ports configured to receive a portion of the shaft.

17. The crutch of claim 1, wherein:

the support base comprises both a U-shaped base element and a U-shaped top element; and the top element is configured to nest within the base element along a top side of the base element.

18. The crutch of claim 1, wherein the U-shaped profile defined by the support base is open along a top side of the support base when the underarm firearm support is in the vertically upright position.

19. The crutch of claim 1, further comprising a looped strap coupled to the support base.

* * * * *